United States Patent [19]

Wardell

[11] 3,965,521

[45] June 29, 1976

[54] CONVERTIBLE MULTI-PURPOSE BRUSH ASSEMBLY

[76] Inventor: Winnifred A. Wardell, 1312 Biltmore Drive, Charlotte, N.C. 28207

[22] Filed: Sept. 19, 1974

[21] Appl. No.: 507,274

[52] U.S. Cl. ..... 15/114; 15/4; 15/97 R; 15/230.11; 15/230.18; 15/230.19; 51/372

[51] Int. Cl.[2] ..... A46B 13/02; A46B 15/00; B05C 17/02; B24D 9/00

[58] Field of Search ..... 15/4, 27, 52, 97 R, 15/97 A, 98, 101, 110, 114, 230, 230.11, 230.16, 230.19, 247; 29/130; 51/181, 372, 375; 64/30 D; 128/57; 401/24, 197, 208

[56] References Cited

UNITED STATES PATENTS

| | | | |
|---|---|---|---|
| 369,513 | 9/1887 | Fox | 51/378 |
| 897,286 | 9/1908 | Haskell | 15/247 |
| 1,189,311 | 7/1916 | Thomson | 15/230.19 |
| 1,364,625 | 1/1921 | Eriksen | 51/181 UX |
| 1,413,574 | 4/1922 | Caplan | 29/130 UX |
| 2,140,578 | 12/1938 | Goodloe | 15/247 UX |
| 2,256,509 | 9/1941 | Young | 15/209 C X |
| 2,384,656 | 9/1945 | Thomas | 51/375 X |
| 2,774,088 | 12/1956 | Liska | 15/230 X |
| 3,307,211 | 3/1967 | Gaines | 15/4 |
| 3,354,488 | 11/1967 | Bilde | 15/98 X |
| 3,424,150 | 1/1969 | Meranto | 15/110 X |
| 3,565,063 | 2/1971 | Wessel | 128/57 |
| 3,597,883 | 8/1971 | Choplin | 51/372 X |

FOREIGN PATENTS OR APPLICATIONS

| | | | |
|---|---|---|---|
| 559,229 | 9/1932 | Germany | 51/372 |

*Primary Examiner*—Daniel Blum
*Attorney, Agent, or Firm*—Bell, Seltzer, Park & Gibson

[57] ABSTRACT

A convertible multi-purpose brush assembly characterized by providing a multiplicity of working surfaces for a variety of tasks and versatility and ease in conversion for various uses. The brush assembly may be constructed for attachment to a home appliance for driving rotation thereof or may be constructed for manual use by an operator. The brush assembly includes a flexible, resilient brush member having a predetermined outside diameter and providing a working surface of a predetermined character for performing certain tasks, and a desired number of hollow sleeve members having a predetermined inside diameter less than the outside diameter of the brush member and providing outside working surfaces of different predetermined characters for performing certain different tasks. The sleeve members are selectively force-fitted on and around the brush member for providing the brush assembly selectively with the outside working surfaces of the sleeve members, while allowing easy replacement of the sleeve members on and removal of the sleeve members from the brush member for converting the brush assembly and selectively providing the brush assembly with other outside working surfaces of the sleeve members or the brush member. The brush assembly may also include a desired number of end cap members selectively and removably secured to the outer longitudinal end portion of the brush member and each having an outside working surface of a predetermined character for performing certain tasks and providing additional versatility to the brush assembly.

13 Claims, 11 Drawing Figures

CONVERTIBLE MULTI-PURPOSE BRUSH ASSEMBLY

BACKGROUND OF THE INVENTION

This invention relates to a convertible multi-purpose brush assembly characterized by providing a multiplicity of working surfaces for a variety of tasks and versatility and ease in conversion for various uses and which may be constructed for attachment to a home appliance such as a rotary drill, mixmaster, etc. for being driven thereby or may be constructed for rotary or fixed manual use by an operator holding the brush assembly.

Various cleaning, polishing, buffing, painting, sanding, etc. tasks performed in the home or elsewhere require the use of a variety of different brushes, working surfaces, etc. for performing these tasks. Heretofore, it was necessary for the person performing these tasks to purchase and maintain a variety of brushes or other materials providing these various working surfaces for performing these various tasks.

Although general utility brush assemblies have heretofore been proposed, such as for example the brush assembly disclosed in U.S. Pat. No. 3,768,109, issued to the inventor of the present invention on Oct. 30, 1973, such brush assemblies have lacked the required versatility for performing a number of different tasks in the home or elsewhere.

SUMMARY OF INVENTION

Accordingly, it is the object of this invention to provide a multi-purpose brush assembly which is capable of performing a variety of tasks of general utility in the home or elsewhere and which is simple in construction and easy to use.

In accordance with the present invention, it has been found that the above object may be accomplished by providing a convertible multi-purpose brush assembly which provides a multiplicity of working surfaces for a variety of tasks and provides versatility and ease in conversion of the brush assembly for various uses.

The brush assembly of this invention broadly includes a generally cylindrical, flexible, resilient brush member having a predetermined outside diameter and providing an outside working surface of a predetermined character for performing certain tasks. The assembly also includes a desired number of sleeve members each defining a hollow, generally cylindrical interior having a predetermined inside diameter less than the outside diameter of the brush member and providing an outside working surface of a different predetermined character than the working surface of the brush member and different from each other for performing certain different tasks.

The sleeve members are selectively force-fitted on and around the brush member, due to the resilience and flexibility thereof and the difference in the diameters, to prevent relative displacement between the members during use of the brush assembly and for providing the brush assembly selectively with the outside working surfaces of the sleeve members, while allowing easy replacement of the sleeve members on and removal of the sleeve members from the brush member for converting the brush assembly and selectively providing the brush assembly with the outside working surfaces of the sleeve members and the brush member.

The brush assembly of this invention may include a desired number of end cap members selectively and removably secured to the outer longitudinal end portion of the brush member. Each of these end cap members has an outside working surface of a predetermined character for performing certain tasks and providing versatility to the brush assembly.

Preferably, the brush member of the assembly of this invention is constructed in accordance with the inventor's above identified U.S. Pat. No. 3,768,109, and may be specifically constructed for attachment to a home appliance, such as a rotary drill, mixmaster, etc. for driving rotation thereof or may be constructed for manual use by an operator.

BRIEF DESCRIPTION OF THE DRAWINGS

Some of the objects and advantages of this invention having been stated, other objects and advantages will appear, when taken in conjunction with the accompanying drawings, in which.

DESCRIPTION OF PREFERRED EMBODIMENT

Figure 1:
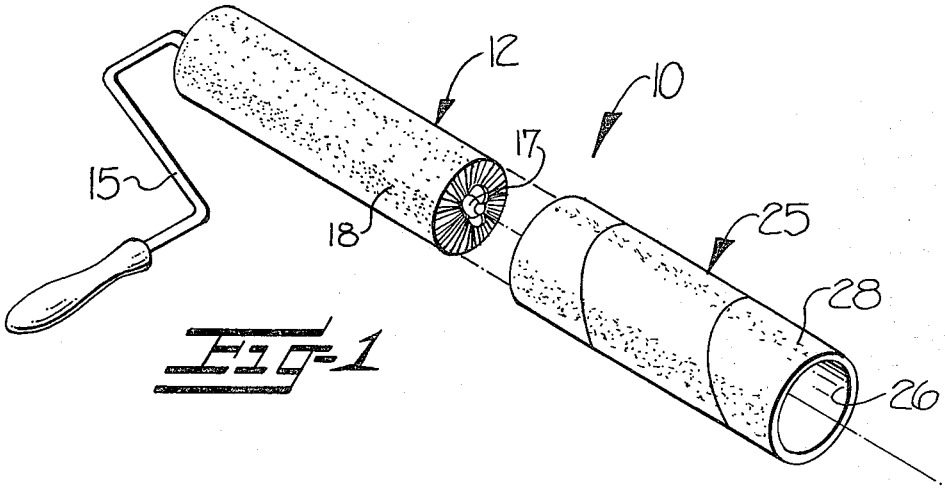
FIG. 1 is a perspective, exploded view of one form of brush assembly in accordance with this invention.

Referring now to the drawings, the convertible multi-purpose brush assembly of this invention is generally indicated therein by the reference numeral 10. FIGS. 1–6 illustrate the brush assembly 10 in a form thereof which is constructed for manual use by an operator and FIGS. 7–11 illustrate the brush assembly 10 specifically constructed for attachment to a home appliance, such as a rotary drill, mixmaster, etc. for rotation thereby, as will be discussed more fully below.

Referring firstly to FIGS. 1–6, the convertible multi-purpose, brush assembly 10 includes a generally cylindrical, flexible, resilient brush member 12 which preferably is constructed in accordance with the inventor's prior above-identified U.S. Pat. No. 3,768,109. This brush member 12 comprises a generally cylindrical support shaft mechanism 13 which in the embodiment of FIGS. 1–6 includes a first cylindrical shaft 14 having a handle member 15 on one end thereof for manual gripping and holding by the user of the brush assembly 10 and a second hollow cylindrical shaft member 16 telescopingly received on the first shaft member 14 for rotation relative thereto. Longitudinal displacement of the two shaft members 14 and 16 is prevented by an end screw member 17 threadingly received in a threaded bore in the outer end of shaft member 14 and a washer 17*a* at the other end of the shaft member 14. The hollow shaft member 16 has an outside diameter of predetermined dimensions, for purposes to be described below.

The shaft member 16 receives a brush 18 in the form of a spiralled, flexible, resilient brush having a hollow interior and having an initial predetermined diameter less than the diameter of the shaft member 16 so that the brush member 18 may be force-fitted onto the shaft member 16 to rotate therewith and to prevent relative displacement of the brush 18 from the shaft 16 during use thereof, while allowing easy disengagement of the brush 18 from the shaft 16 for cleaning and replacement. The outside surface of the shaft 16 may be knurled or otherwise roughened to increase surface friction and aid in the force-fitting of the brush 18 thereon. The brush 18 preferably comprises a spiralled resilient base portion 20 having a generally U-shaped, transverse, cross-sectional configuration and a plurality of individual bristles 21 of a predetermined length and being bent into U-shaped configuration and being secured within the base portion 20 around a wire 22 at the bend of each bristle 21 for extending longitudinally outwardly therefrom to define an outside diameter of the brush 18 of predetermined dimensions, as indicated by the arrows in FIG. 2. Further details of the brush member 12 may be had by reference to the inventor's above-identified prior U.S. pat.

Although the brush assembly 10 of the present invention is described utilizing the preferred brush member 12 of the inventor's U.S. Pat., it is to be understood that other generally cylindrical brush members may be utilized within the combination of the present invention.

Figure 2:
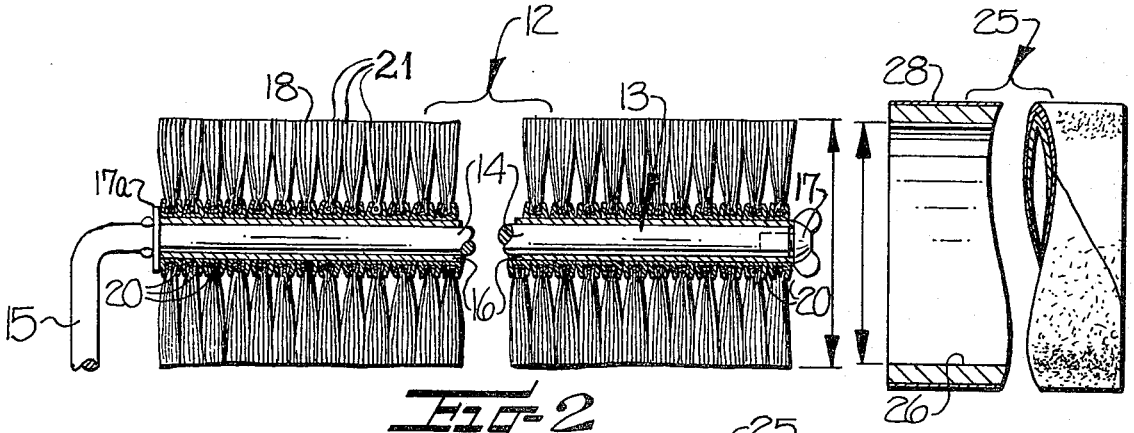
FIG. 2 is an enlarged, partial, cross-sectional, exploded view, broken away, of the brush assembly of FIG. 1.
Figure 3:
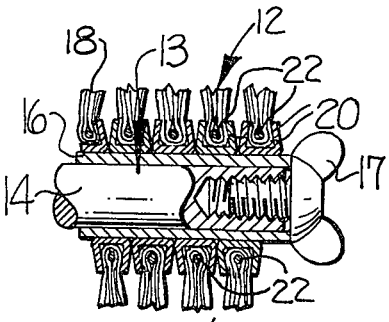
FIG. 3 is an enlarged, partial, cross-sectional view of the end portion of the brush member of the assembly of FIG. 1.

The brush assembly 10 of the present invention further includes a desired number of sleeve members 25 each of which define a hollow, generally cylindrical interior 26 having a predetermined inside diameter less than the outside diameter of the brush member 12, as indicated by the arrows in FIG. 2, so that the sleeve members 25 may be selectively force-fitted on and around the brush member 12 by sliding the hollow interior 26 thereof over the bristles 21 of the brush member 12 and forming a force-fit between the selected sleeve member 25 and the brush member 12 due to the resilience and flexibility of the brush member 12 and the difference in diameters between the sleeve 25 and the brush member 12. This will prevent relative displacement between the sleeve member 25 and the brush 12 during use of the assembly 10, while allowing easy removal of the sleeve 25 from the brush member 12.

Figure 4:
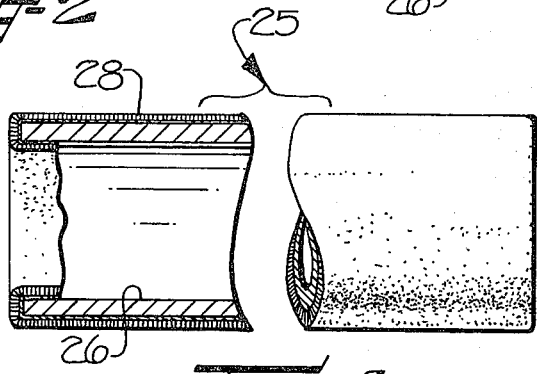
FIG. 4 is an elevational view, broken away and partly in section, of one of the sleeve members of the assembly of FIG. 1.
Figure 5:
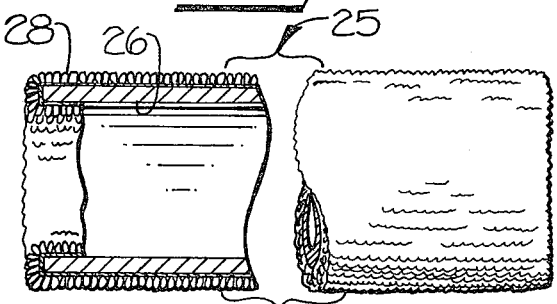
FIG. 5 is a view, like FIG. 4, of a different sleeve member for the brush assembly of FIG. 1.

The sleeve members 25 provide outside working surfaces 28 of desired construction for performing certain different tasks than are intended for performance by the brush member 12. These working surfaces may include a sandpaper surface such as schematically illustrated in FIG. 1 and 2, or a velvet surface such as schematically illustrated in FIG. 4, or a terrycloth surface such as schematically illustrated in FIG. 5. These described working surfaces 28 for the sleeve members 25 are only exemplary and a wide variety of sleeve members 25 with a wide variety of working surfaces may be provided with the brush assembly 10 of this invention. Also, it is to be understood that one or a multiplicity of sleeve members may be used in combination with the brush member 12 in the convertible brush assembly 10 of this invention.

According to the desired use of the brush assembly 10 of FIGS. 1–6, the brush assembly may be rotary or fixed. This may be accomplished by positioning the end screw member 17 in loose relation in the shaft 14 so that the shaft 16 is freely rotatable on the shaft 14 for providing a rotary brush assembly 10 or by positioning the end screw member 17 in tight relation in the shaft 14 for braking or fixing the shaft 16 in tight engagement between the members 17 and 17*a* to prevent relative movement between the shafts 14 and 16 and provide a fixed brush assembly 10 for non-rotary uses, such as sanding, buffing, etc. If desired, a separate braking member may be used.

Thus, it may be seen that the sleeve members 25 may be selectively force-fitted onto the brush member 12 of the assembly 10 for providing the brush assembly 10 selectively with the various outside working surfaces 28 of the sleeve members 25 depending upon the desired task to be performed with the brush assembly 10, or the sleeves 25 may be completely removed from the brush member 12 to provide a brush assembly 10 having the outside working surface of the brush member 12 alone.

Figure 6:
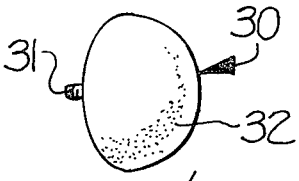
FIG. 6 is a perspective view of a suitable end cap member which may be utilized with the brush assembly of FIG. 1.

If desired for certain tasks, the end screw member 17 may be removed and replaced by a desired number of end cap members 30, as shown in FIG. 6. These end cap members 30 may comprise a generally semi-spherical member having a projecting threaded screw 31 for securement to the outside longitudinal end of the shaft 14 of the support shaft assembly 14 and the end cap members 30 include outside working surfaces 32 of any desired material such as sandpaper, velvet, terrycloth, etc., discussed above with respect to the working surface 28 of the sleeve members 25. These end cap members 30 may be utilized with a selected sleeve 25 in position on the brush member 12 or with the sleeves 25 removed from the brush member 12. Also, the semi-spherical shape of the end cap member 30 when assembled on the brush member 12 and with a selected sleeve 25 in position may form a rounded extension of the sleeve 25, as may be seen in FIG. 8, or may have smaller dimensions. The same type of outside working surface 32 may be used on the end cap member 30, selectively assembled on the brush assembly 10, as the outside working surface 28 of the sleeve 25, selectively assembled on the brush assembly 10.

Thus, it is evident that the multi-purpose brush assembly of FIGS. 1–6 provide a manually grippable brush assembly which is constructed to be either rotated or used in a braked, fixed relation by an operator and which provides a wide variety of working surfaces including the working surface of the brush member 10 and the working surfaces of the selected sleeve member 25 and the selected end cap member 30 so that the user of the brush assembly 10 may select a desirable working surface for the task which he is performing with the brush assembly 10.

Figure 7:
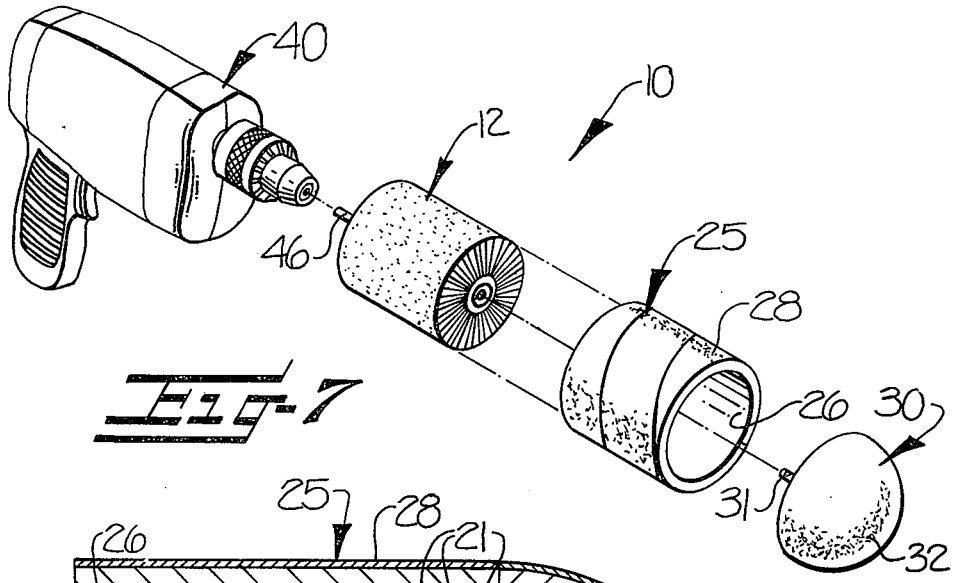
FIG. 7 is an exploded, perspective view of another form of brush assembly in accordance with this invention.
Figure 8:
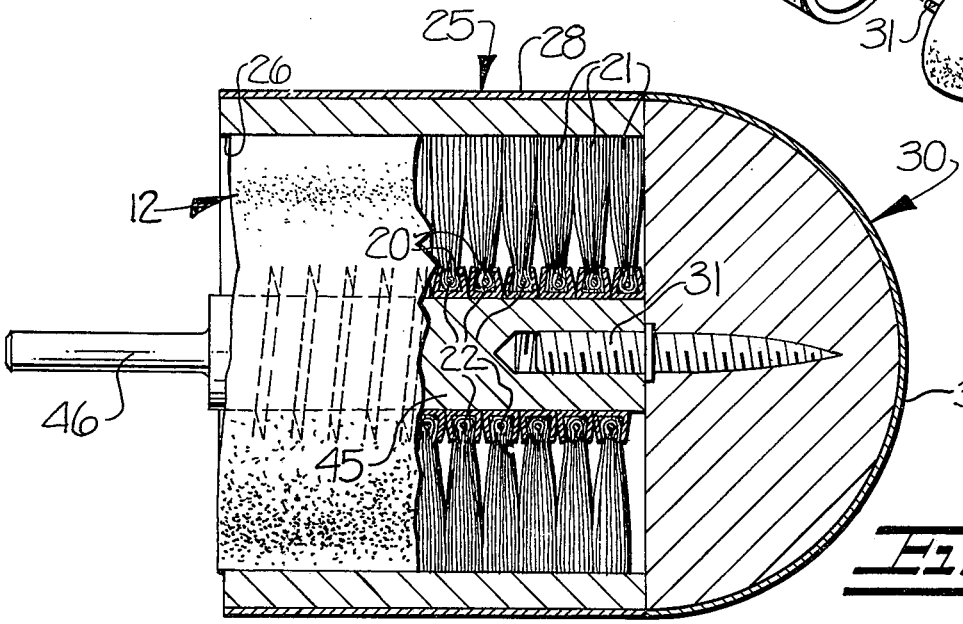
FIG. 8 is an enlarged, cross-sectional view of the brush assembly of FIG. 7 with the components thereof in assembled condition.

Referring now to the form of the convertible multi-purpose brush assembly 10, illustrated in FIGS. 7–11, this form of brush assembly 10 is basically of the same construction as that illustrated in FIGS. 1–6 and like reference characters for like components have been utilized in FIGS. 7–11. The brush assembly 10 of FIGS. 7–11 differs from that of FIGS. 1–6 in being specifically constructed for attachment to a suitable home appliance 40, such as a rotary drill as illustrated in FIG. 7. It is to be borne in mind that the home appliance 40 may include a rotary drill, mixmaster or other suitable mechanism for driving the rotary brush assembly 10.

In this connection, the supporting shaft mechanism 13 of the brush assembly 10 of FIGS. 1–6 may be used in the brush assembly of FIGS. 7–11 or may be replaced in the brush assembly 10 of FIGS. 7–11 by a single piece support shaft 45 which receives the brush 18 thereon in a force-fitted relationship, as discussed above. The outer extending end 46 of the support shaft 45 or of the shaft 41 is constructed for reception in a conventional rotary drill, mixmaster, or other home appliance 40 so that the brush assembly 10 may be rotated by the suitable home appliance in performing its various tasks.

Although the brush assembly 10 of FIGS. 7–11 is shown as being shorter in length, the length of the brush assemblies 10 of either FIGS. 1–6 or 7–11 may be of any desired dimensions.

Figure 9:
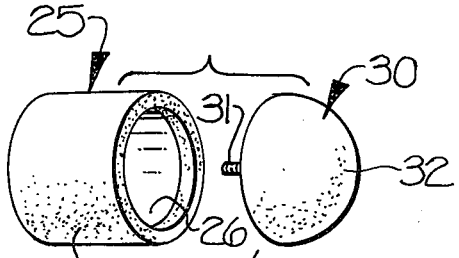
FIG. 9 is a perspective, composite view of one form of sleeve member and end cap member which may be utilized in the brush assembly of FIGS. 7 and 8.
Figure 10:
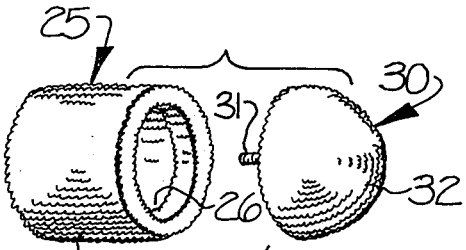
FIG. 10 is a perspective, composite view of another sleeve member and end cap member which may be utilized in the brush assembly of FIGS. 7 and 8.
Figure 11:
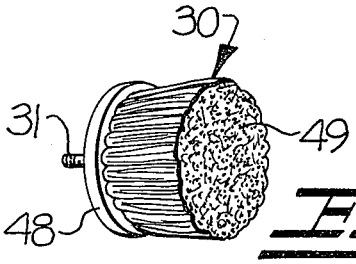
FIG. 11 is a perspective view of another form of end cap member which may be utilized with the brush assembly of either FIG. 7 or FIG. 1.

Additionally, there is illustrated in FIG. 11, a further alternate form of end cap member 30 which comprises basically a base 48 carrying the screw member 31 and having brush bristles 49 extending longitudinally outwardly therefrom. This end cap member 30 of FIG. 11 may be secured to the end of the shaft 45 in the same manner that the other semi-spherical end cap members are secured thereto. FIGS. 9 and 10 illustrate exemplary forms of sleeve members 25 and end cap members 30 which may be utilized with brush assembly 10 of FIGS. 7 and 8 or with the brush assembly 10 of FIGS. 1 and 2. The sleeve member 25 and end cap member 30 of FIG. 9 illustrate working surfaces 28 and 32, respectively, of velvet material and the sleeve member 25 and the end cap member 30 of FIG. 10 illustrate working surfaces 28 and 32, respectively, of terrycloth material. It is to be understood that any suitable working surface may be provided on the end cap members 30 and the sleeve members 25 for providing the desired versatility to the brush assembly 10.

Accordingly, the present invention has provided a convertible multi-purpose brush assembly which is characterized by providing a multiplicity of working surfaces for a variety of tasks in one assembly or kit which provides versatility and ease in conversion for various uses and which has not heretofore been available in any known brush assembly.

In the drawings and specification there has been set forth preferred embodiments of this invention and, although specific terms are employed, they are used in a generic and descriptive sense only and not for purposes of limitation.

What is claimed is:

1. A convertible multi-purpose brush assembly characterized by providing a multiplicity of working surfaces for a variety of tasks and versatility and ease in conversion for various uses; said brush assembly comprising:

a generally cylindrical, flexible, resilient brush member having a predetermined outside diameter and providing an outside working surface of a predetermined character for performing certain tasks and having at least one substantially unobstructed end;

a desired plurality of sleeve members each defining a hollow, generally cylindrical interior having a predetermined inside diameter less than the outside diameter of said brush member and each providing an outside working surface of a different predetermined character than said working surface of said brush member and different from each other for performing certain different tasks;

said sleeve members being selectively and removably force-fitted one at a time on and around said brush member from said substantially unobstructed end thereof due to the resilience and flexibility thereof and the difference in the diameters to prevent relative displacement between said members during use of said brush assembly and for providing said brush assembly selectively with said outside working surfaces of said sleeve members, while allowing easy replacement of said sleeve members and removal of said sleeve members from said brush member for converting said brush member and selectively providing said brush member with said outside working surfaces of said sleeve members and said brush member; and a desired number of end cap members selectively and removably secured to the outer longitudinal end portion of said brush member and each having an outside working surface of a predetermined character for performing certain tasks and for providing additional versatility to said brush member.

2. A convertible multi-purpose brush assembly, as set forth in claim 1, in which said end cap members comprises a generally semi-spherical member having outside working surfaces of the same character as said sleeve members and having diameters generally the same as said sleeve members so as to form a rounded extension of the said sleeve member when said sleeve member is positioned on said brush member and said end cap member is secured to said brush member.

3. A convertible multi-purpose brush assembly, as set forth in claim 1, in which one of said end cap members includes a plurality of individual flexible bristles of a predetermined length extending outwardly therefrom generally longitudinally of said brush assembly when assembled thereon.

4. A convertible multi-purpose brush assembly characterized by providing a multiplicity of working surface for a variety of tasks and versatility and ease in conversion for various uses; said brush member comprising:

a generally cylindrical support shaft means having a predetermined diameter;

a generally cylindrical, flexible, resilient brush member having a predetermined outside diameter and providing an outside working surface of a predetermined character for performing certain tasks and having at least one substantially unobstructed end, said brush member comprising a spiralled, flexible, resilient brush member defining a hollow interior having an initial predetermined diameter less than the diameter of said support shaft means, said brush member being force-fitted on said support shaft means to prevent relative displacement during use thereof but allowing disengagement of said brush member from said support shaft means for cleaning and replacement;

a desired plurality of sleeve members each defining a hollow, generally cylindrical interior having a predetermined inside diameter less than the outside diameter of said brush member and each providing an outside working surface of a different predetermined character than said working surface of said brush member and different from each other for performing certain different tasks; and said sleeve members being selectively and removably force-fitted one at a time on and around said brush member from said substantially unobstructed end thereof due to the resilience and flexibility thereof and the difference in the diameters to prevent relative displacement between said members during use of said brush assembly and for providing said brush assembly selectively with said outside working surfaces of said sleeve members, while allowing easy replacement of said sleeve members on and removal of said sleeve members from said brush member for converting said brush assembly and selectively providing said brush assembly with said outside working surfaces of said sleeve members and said brush member.

5. A convertible multi-purpose brush assembly, as set forth in claim 4, in which said flexible brush member comprises a spiralled, resilient, base portion having a generally U-shaped, transverse, cross-sectional configuration, and a plurality of individual flexible bristles secured within said base portion and extending longitudinally outwardly therefrom.

6. A convertible multi-purpose brush assembly, as set forth in claim 4, in which said support shaft means comprises a first cylindrical member, and a second hollow cylindrical member telescopingly received on said first member for rotation relative thereto or for being fixed thereto and for receiving said spiralled resilient brush member for forming a rotary brush assembly.

7. A convertible multi-purpose brush assembly, as set forth in claim 6, in which said first cylindrical member forming a part of said support shaft means includes a manually grippable handle attached thereto for holding by an operator for manual use of said brush assembly.

8. A convertible multi-purpose brush assembly, as set forth in claim 4, in which said brush assembly further includes means supporting said shaft support means for rotation and including means thereon for attachment to a suitable drive means for rotation thereof to provide a driven rotary brush assembly.

9. A convertible multi-purpose brush assembly for attachment to a home appliance such as a rotary drill, mixmaster, etc., for being driven thereby and being characterized by providing a multiplicity of working surfaces for a variety of tasks and versatility and ease in conversion for various uses; said brush assembly comprising:

a support shaft means having means thereon for reception by a suitable home appliance to be rotated thereby;

a generally cylindrical, flexible, resilient brush member mounted on said support shaft means and having a predetermined outside diameter and providing an outside working surface of a predetermined character for performing certain tasks and having at least one substantially unobstructed end;

a desired plurality of sleeve members each defining a hollow, generally cylindrical interior having a predetermined inside diameter less than the outside diameter of said brush member and providing an outside working surface of a different predetermined character than said working surface of said brush member and different from each other for performing certain different tasks;

said sleeve members being selectively and removably force-fitted one at a time on and around said brush member from said substantially unobstructed end thereof due to the resilience and flexibility thereof and the difference in the diameters to prevent relative displacement between said members during use of said brush member and for providing said brush member selectively with said outside working surfaces of said sleeve members, while allowing easy replacement of said sleeve members on and removal of said sleeve members from said brush member for converting said brush assembly and providing said brush assembly with said outside working surfaces of said sleeve members and said brush member; and and end cap member removably secured to the outer longitudinal end portion of said brush member and having an outside working surface of a predetermined character for performing certain different tasks and providing additional versatility to said brush assembly.

10. A convertible multi-purpose brush assembly for attachment to a home appliance such as a rotary drill, mixmaster, etc., for being driven thereby and being characterized by providing a multiplicity of working surfaces for a variety of tasks and versatility and ease in conversion for various uses; said brush assembly comprising:

a support shaft means comprising a generally cylindrical shaft having a predetermined diameter and having means thereon for reception by a suitable home appliance to be rotated thereby;

a generally cylindrical, flexible, resilient brush member mounted on said support shaft means and having a predetermined outside diameter and providing an outside working surface of a predetermined character for performing certain tasks and having at least one substantially unobstructed end, said brush member comprising a spiralled, flexible, resilient brush member having a hollow interior and having an initial predetermined diameter less than the diameter of said support shaft means, said brush member being force-fitted on said support shaft means to prevent relative displacement during use thereof but allowing disengagement of said brush member from said support shaft means for cleaning and replacement;

a desired plurality of sleeve members each defining a hollow, generally cylindrical interior having a predetermined inside diameter less than the outside diameter of said brush member and providing an outside working surface of a different predetermined character than said working surface of said brush member and different from each other for performing certain different tasks; and said sleeve members being selectively and removably force-fitted one at a time on and around said brush member from said substantially unobstructed end thereof due to the resilience and flexibility thereof and the difference in the diameters to prevent relative displacement between said members during use of said brush member and for providing said brush member selectively with said outside working surfaces of said sleeve members, while allowing easy replacement of said sleeve members on and removal of said sleeve members from said brush member for converting said brush member and providing said brush assembly with said outside working surfaces of said sleeve member and said brush member.

11. A convertible multi-purpose brush assembly for manual use by an operator and being characterized by providing a multiplicity of working surfaces for a variety of tasks and versatility and ease in conversion for various uses; said brush assembly comprising a support shaft means including a first cylindrical member having a handle portion on one end thereof for manual gripping by an operator for holding said brush assembly and a second hollow cylindrical member telescopingly received on said first member for rotation relative thereto or for being fixed thereto;

a generally cylindrical, flexible, resilient brush member fixedly mounted on said second cylindrical member of said support shaft means and having a predetermined outside diameter and providing an outside working surface of a predetermined character for performing certain tasks;

a desired number of sleeve members each defining a hollow, generally cylindrical interior having a predetermined inside diameter less than the outside diameter of said brush member and providing an outside working surface of a different predetermined character than said working surface of said brush member and different from each other for performing certain tasks;

said sleeve members being selectively force-fitted on and around said brush member due to the resilience and flexibility thereof and the difference in the diameters to prevent relative displacement between said members during use of said brush member and for providing said brush member selectively with said outside working surfaces of said sleeve members, while allowing easy replacement of said sleeve members on and removal of said sleeve member from said brush member for converting said brush assembly and providing said brush assembly with said outside working surfaces of said sleeve members and said brush member; and braking means operatively associated with said support shaft means for selectively allowing relative rotation between said shaft members for providing a rotary brush assembly or for preventing relative rotation between said shaft members for providing a non-rotary brush assembly.

12. A convertible multi-purpose brush assembly, as set forth in claim 11, in which said second cylindrical member of said support shaft means has a predetermined diameter, and in which said brush member comprises a spiralled, flexible, resilient brush member having a hollow interior and having an initial predetermined diameter less than the diameter of said second cylindrical member of said support shaft means, said brush member being force-fitted on said second cylindrical member of said support shaft means to prevent relative displacement thereof during use but allowing disengagement of said brush member from said support shaft means for cleaning and replacement.

13. A convertible multi-purpose brush assembly, as set forth in claim 11, in which said brush member comprises a spiralled, resilient, base portion having a generally U-shaped, transverse, cross-sectional configuration, and a plurality of individual flexible bristles of a predetermined length secured within said base portion and extending longitudinally outward therefrom.

* * * * *